US007210318B2

(12) United States Patent
Yu

(10) Patent No.: US 7,210,318 B2
(45) Date of Patent: May 1, 2007

(54) PADLOCK

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 0 days.

(21) Appl. No.: 11/448,087

(22) Filed: Jun. 7, 2006

(65) Prior Publication Data

US 2006/0218981 A1 Oct. 5, 2006

Related U.S. Application Data

(63) Continuation-in-part of application No. 10/671,659, filed on Sep. 29, 2003.

(51) Int. Cl.
*E05B 37/02* (2006.01)

(52) U.S. Cl. ..... 70/21; 70/25; 70/284; 70/285; 70/DIG. 63

(58) Field of Classification Search ..... 70/21, 70/25, 284, 285, 38 R, 38 A, DIG. 63, DIG. 71
See application file for complete search history.

(56) References Cited

U.S. PATENT DOCUMENTS

| | | | | | |
|---|---|---|---|---|---|
| 1,622,999 | A * | 3/1927 | Frith | 70/38 A |
| 2,497,619 | A * | 2/1950 | Adolph | 70/25 |
| 3,349,584 | A * | 10/1967 | Russell et al. | 70/21 |
| 3,472,049 | A * | 10/1969 | Sewell | 70/21 |
| 3,729,962 | A * | 5/1973 | Harrington et al. | 70/25 |
| 3,823,584 | A * | 7/1974 | Gill | 70/21 |
| 3,894,415 | A * | 7/1975 | Bako | 70/21 |
| 3,952,559 | A * | 4/1976 | Atkinson | 70/25 |
| 4,462,231 | A * | 7/1984 | Zabel | 70/21 |
| 4,751,830 | A | 6/1988 | Cheng | |
| 5,363,678 | A * | 11/1994 | Meckbach | 70/38 A |
| 6,035,672 | A * | 3/2000 | Lai | 70/25 |
| 6,539,761 | B2 | 4/2003 | Yang | |
| 6,644,076 | B2 * | 11/2003 | Huang | 70/379 R |
| 6,708,534 | B1 * | 3/2004 | Ruan | 70/38 A |
| 6,848,283 | B1 | 2/2005 | Lin | |
| 6,860,125 | B1 * | 3/2005 | Yu | 70/25 |
| 6,877,345 | B1 * | 4/2005 | Misner et al. | 70/25 |
| 2002/0088256 | A1 | 7/2002 | Taylor et al. | |
| 2003/0000264 | A1 * | 1/2003 | Yang | 70/25 |
| 2004/0226323 | A1 | 11/2004 | Ling et al. | |
| 2004/0226324 | A1 | 11/2004 | Loughlin et al. | |

(Continued)

*Primary Examiner*—Lloyd A. Gall
(74) *Attorney, Agent, or Firm*—Rosenberg, Klein & Lee

(57) ABSTRACT

A padlock comprises a lock body, a shackle, a block member, an elastic member, a combination locking device and a key locking device. The shackle is movable relative to the lock body between a locked position and an unlocked position, and the shackle has a first end movably installed in the lock body and a second end. The block member is movably connected to the lock body and comprises a button provided for retaining the second end of the shackle in the locked position, a supporter protruding from the button, and a base protruding from the supporter. The elastic member is installed around the button and has one end against the lock body and the other end against the supporter. The combination locking device is installed within the lock body for controlling movements of the shackle. The first end of the shackle is movable to the unlocked position when the combination locking device is unlocked. The key locking device is installed within the lock body and connected to the base of the block member for controlling movements of the shackle. The block member is movable axially, when the key locking device is operated by a key.

4 Claims, 2 Drawing Sheets

U.S. PATENT DOCUMENTS

2005/0034492 A1* 2/2005 Yu ..... 70/25
2005/0039500 A1* 2/2005 Yu ..... 70/25
2005/0039501 A1* 2/2005 Yu ..... 70/29
2005/0044901 A1* 3/2005 Yu ..... 70/25
2005/0092036 A1 5/2005 Lai
2005/0132762 A1* 6/2005 Yu ..... 70/25
2005/0262902 A1* 12/2005 Ling et al. ..... 70/21
2006/0266084 A1* 11/2006 Kuo et al. ..... 70/21

* cited by examiner

PADLOCK

CROSS-REFERENCE

This is a continuation-in-part application of the co-pending U.S. Ser. No. 10/671,659, filed on Sep. 29, 2003.

TECHNICAL FIELD

This invention relates generally to a padlock, in particular, to a padlock which has a block member and a dual locking device.

BACKGROUND OF THE INVENTION

A conventional padlock generally includes a lock body, a locking device and a shackle so as to lock an object, as disclosed in U.S. Pat. Nos. 4,751,830 and 6,539,761. Another conventional padlock not only includes a lock body, a dual locking device and a shackle, but also includes a block member to retain or to release the shackle, also as disclosed in U.S. Pat. No. 6,848,283 and U.S. Patent Publication Nos. 2002/0088256, 2004/0226323 and 2004/0226324. The block member of the conventional padlock is mainly arranged for the dual locking device, especially for a key locking device as so to controlling movements of the shackle. However, connections between the block member and the dual locking device are arranged to be complicated. Therefore, an improved padlock is in great demand.

SUMMARY OF INVENTION

It is therefore an object of the present invention to provide a padlock, which has a block member and a dual locking device.

More specifically, the padlock of the present invention comprises a lock body, a shackle, a block member, an elastic member, a combination locking device and a key locking device. The shackle is movable relative to the lock body between a locked position and an unlocked position, and the shackle has a first end movably installed in the lock body and a second end. The block member is movably connected to the lock body and comprises a button provided for retaining the second end of the shackle in the locked position, a supporter protruding from the button, and a base protruding from the supporter. The elastic member is installed around the button and has one end against the lock body and the other end against the supporter. The combination locking device is installed within the lock body for controlling movements of the shackle. The first end of the shackle is movable to the unlocked position when the combination locking device is unlocked. The key locking device is installed within the lock body and connected to the base of the block member for controlling movements of the shackle. The block member is movable axially, when the key locking device is operated by a key.

BRIEF DESCRIPTION OF DRAWINGS

The invention will be more clearly understood after referring to the following detailed description read in conjunction with the drawings wherein.

DETAILED DESCRIPTION OF PREFERRED EMBODIMENTS

Figure 2:
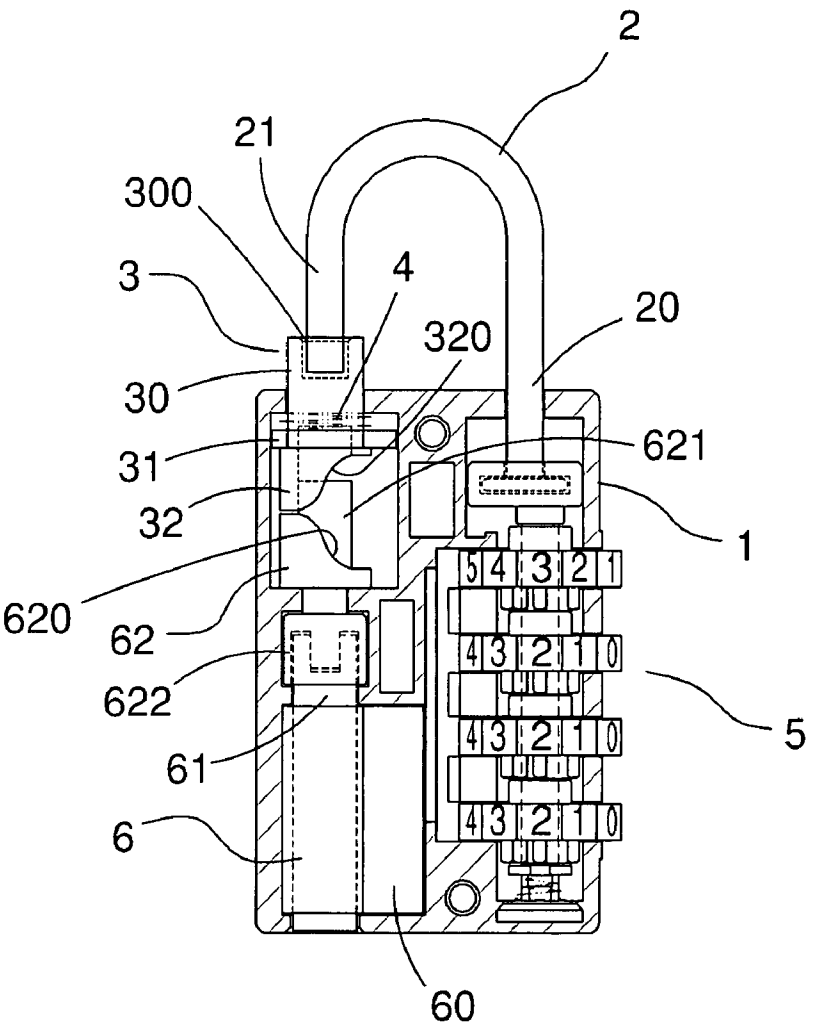
FIG. 2 is a cross sectional view of the padlock, showing a shackle of the padlock being in a locked position.
Figure 1:
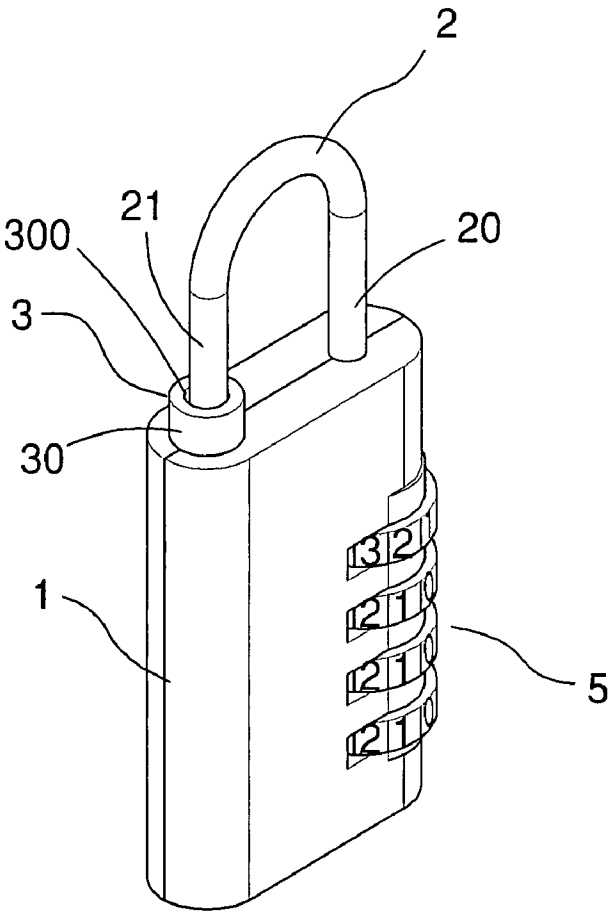
FIG. 1 is a perspective view of a padlock as a preferred embodiment of the present invention.

FIGS. 1–4 show a padlock as a preferred embodiment of the present invention. In FIGS. 1 and 2, the padlock comprises a lock body 1, a shackle 2, a block member 3, an elastic member 4, a combination locking device 5 and a key locking device 6. The shackle 2 is movable relative to the lock body 1 between a locked position and an unlocked position, and the shackle 2 has a first end 20 movably installed in the lock body 1 and a second end 21. The block member 3 is movably connected to the lock body 1 and comprises a button 30 provided for retaining the second end 21 of the shackle 2 in the locked position, a supporter 31 protruding from the button 30, and a base 32 protruding from the supporter 31. Additionally, the supporter 31 and the base 32 are installed within the lock body 1. The button 30 is movable to expose to the lock body 1 or to conceal from the lock body 1. Furthermore, the button 30 of the block member 3 has a recess 300 for receiving the second end 21 of the shackle 2, and the recess 300 is formed on a top surface of the button 30.

As shown in FIG. 2, the elastic member 4 is installed around the button 30 and has one end against the lock body 1 and the other end against the supporter 31. Preferably, the elastic member 4 is a compression spring in the present invention. The combination locking device 5 is installed within the lock body 1 for controlling movements of the shackle 2. The first end 20 of the shackle 2 is movable axially and rotatable to the unlocked position when the combination locking device 5 is unlocked. The key locking device 6 is installed within the lock body 1 and connected to the base 32 of the block member 3 for controlling movements of the shackle 2. The block member 3 is movable axially, when the key locking device 6 is operated by a key 7, which is a unique key and possessed by an authorized official only.

Figure 3:
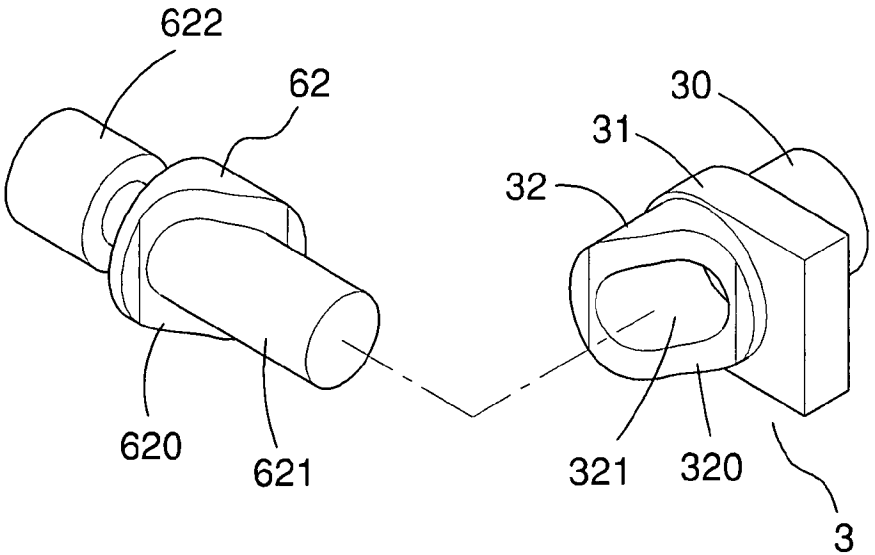
FIG. 3 is an exploded view of a block member and a control unit of the padlock.

In FIGS. 2 and 3, the base 32 of the block member 3 has an inclined surface 320, which has a hole 321 therein, and the key locking device 6 comprises a body 60, a rotor 61 and a control unit 62. The body is fixed in the lock body 1. The rotor 61 is installed in the body 60 and has a first end for receiving the key 7 and a second end extending from the body 60. The control unit 62 is rotatably connected to the second end of the rotor 61 and has a slope surface 620 engageable with the inclined surface 320 of the base 32. Furthermore, the slope surface 620 has a cylinder 621 formed thereon so as to engage with the hole 321, and has a mounting portion 622 for mounting on the second end of the rotor 61.

FIG. 2 shows the padlock being locked, and the block member 3 being exposed to the lock body 1 to retain the second end 21 of the shackle 2 in the locked position where an edge of the inclined surface 320 of the base 32 contacts with an edge of the slope surface 620 of the control unit 62. Additionally, both the combination locking device 5 and the key locking device 6 are not operated.

Figure 4:
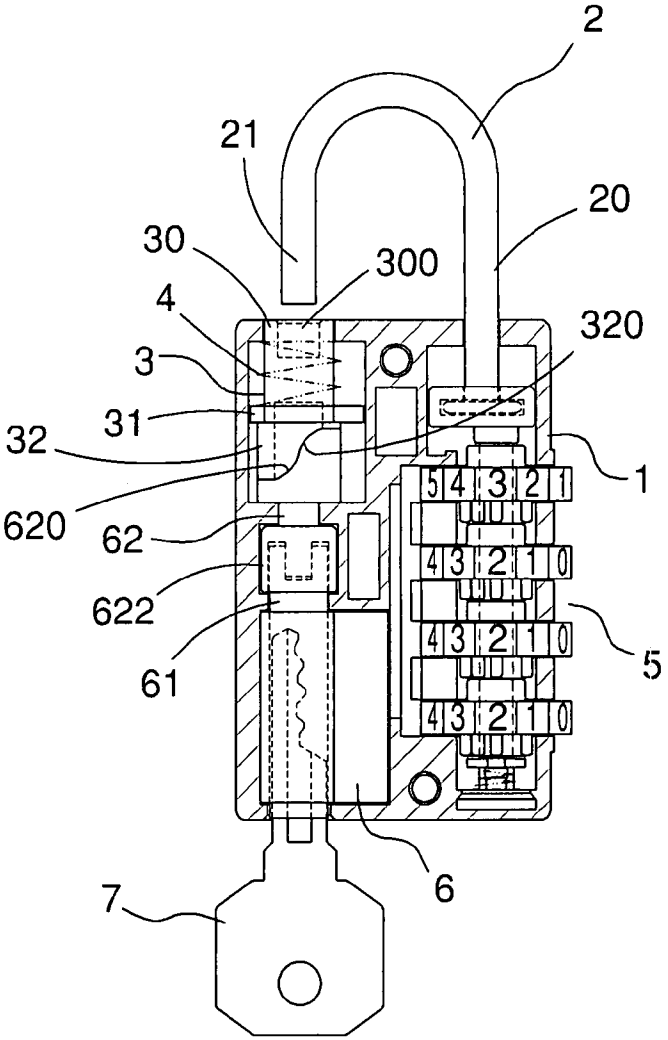
FIG. 4 is a cross sectional view of the padlock, showing the shackle being in an unlocked position by operating a key locking device.

FIG. 4 shows the padlock being unlocked by operating the key locking device 6 via the key 7, and the block member 3 being concealed from the lock body 1 to allow the second end 21 of the shackle 2 moving to the unlocked position where the inclined surface 320 of the base 32 is engaged with the slope surface 620 of the control unit 62 by operating the key 7 to drive the rotor 61 to rotate the slope surface 620 via the mounting portion 622. When the slope surface 620 is rotated, the inclined surface 320 is moved downwardly so as to engage with the slope surface 620. Accordingly, the button 30 of the block member 3 is concealed from the lock body 1, and can move steadily and synchronously via the elastic member 4.

Additionally, when the padlock being unlocked by operating the combination locking device 5 via dialing a set of unlocking codes, the first end 20 of the shackle 2 can be axially and rotatably moved to the unlocked position, and the second end 21 of the shackle 2 can accordingly move away from the button 30 of the block member 3.

Numerous characteristics and advantages of the invention have been set forth in the foregoing description, together with details of the structure and function of the invention, and the novel features thereof are pointed out in appended claims. The disclosure, however, is illustrative only, and changes may be made in detail, especially, in matters of shape, size and arrangement of parts, materials and the combination thereof within the principle of the invention, to the full extent indicated by the broad general meaning of the terms in which the appended claims are expressed.

I claim:

1. A padlock comprising:

a lock body;

a shackle, movable relative to the lock body between a locked position and an unlocked position, the shackle having a first end movably installed in the lock body and a second end;

a block member, movably connected to the lock body and comprising a button provided for retaining the second end of the shackle in the locked position, a supporter protruding from the button, and a base protruding from the supporter; wherein the supporter and the base are installed within the lock body;

an elastic member, installed around the button and having one end against the lock body and the other end against the supporter;

a combination locking device, installed within the lock body for controlling movements of the shackle, wherein the first end of the shackle is movable to the unlocked position when the combination locking device is unlocked; and a key locking device, installed within the lock body and connected to the base of the block member for controlling movements of the shackle, wherein the block member is movable axially, when the key locking device is operated by a key.

2. The padlock of claim 1, wherein the base of the block member has an inclined surface and the key locking device comprises:

a body;

a rotor, installed in the body and having a first end for receiving the key and a second end extending from the body; and a control unit, connected to the second end of the rotor and having a slope surface engageable with the inclined surface of the base.

3. The padlock of claim 1, wherein the button of the block member has a recess for receiving the second end of the shackle and the recess is formed on a top surface of the button.

4. The padlock of claim 2, wherein the inclined surface of the base has a hole therein and the slope surface of the control unit has a cylinder thereon so as to engage with the hole.

* * * * *